US008159807B2

(12) United States Patent
Pohl

(10) Patent No.: US 8,159,807 B2
(45) Date of Patent: Apr. 17, 2012

(54) METHOD AND DEVICE FOR OPERATING A SWITCHING DEVICE

(75) Inventor: Fritz Pohl, Hemhofen (DE)

(73) Assignee: Siemens Aktiengesellschaft, Munich (DE)

( * ) Notice: Subject to any disclaimer, the term of this patent is extended or adjusted under 35 U.S.C. 154(b) by 433 days.

(21) Appl. No.: 12/086,870

(22) PCT Filed: Dec. 22, 2005

(86) PCT No.: PCT/EP2005/057075

§ 371 (c)(1),
(2), (4) Date: Jun. 20, 2008

(87) PCT Pub. No.: WO2007/079767

PCT Pub. Date: Jul. 19, 2007

(65) Prior Publication Data

US 2010/0165535 A1 Jul. 1, 2010

(51) Int. Cl.
*H01H 47/00* (2006.01)

(52) U.S. Cl. ..... 361/160

(58) Field of Classification Search ..... 361/160, 361/142; 355/229

See application file for complete search history.

(56) References Cited

U.S. PATENT DOCUMENTS

| | | | | |
|---|---|---|---|---|
| 4,608,620 | A | 8/1986 | Hines | |
| 4,686,501 | A * | 8/1987 | Palmier et al. | 335/256 |
| 5,032,812 | A | 7/1991 | Banick | |
| 5,153,522 | A * | 10/1992 | Sano | 324/546 |
| 6,321,781 | B1 | 11/2001 | Kurth | |
| 6,493,202 | B2 * | 12/2002 | Kappel et al. | 361/152 |
| 6,650,106 | B2 * | 11/2003 | Daalmans et al. | 324/164 |

FOREIGN PATENT DOCUMENTS

| | | |
|---|---|---|
| DE | 3637133 A1 | 5/1987 |
| DE | 19544207 A1 | 6/1997 |
| JP | 62-119828 | 6/1987 |
| JP | 2-220322 | 9/1990 |
| JP | 4-092332 | 3/1992 |
| JP | 6-147034 | 5/1994 |
| JP | 2000-501550 | 2/2000 |

OTHER PUBLICATIONS

IEEE, The Authoritative Dictionary of IEEE Standards Terms, 2000, Standards Information Network IEEE Press, Seven Edition, 186.*

Office Action for Japanese patent application No. 2008-546147 dated Nov. 19, 2010 (in German).

Office Action for Japanese patent application No. 2008-546147 issued on Jul. 1, 2011 (in German).

* cited by examiner

*Primary Examiner* — Rexford Barnie
*Assistant Examiner* — Tien Mai
(74) *Attorney, Agent, or Firm* — Harness, Dickey & Pierce, P.L.C.

(57) ABSTRACT

A method is disclosed for operating a switching device using at least one electromagnetic drive, which has a displaceable armature for opening and closing at least one main contact of the switching device. According to at least one embodiment of the invention, a modification of the magnetic flux between a first position, when the main contact is deactivated, and a second position, when the main contact is activated, is identified in the electromagnetic drive and a solenoid current of the electromagnetic drive is restricted to a predetermined minimum current value in the second position, if the magnetic flux modification exceeds a predeterminable value. One advantage of at least one embodiment is that an actuation displacement of the armature can be identified as reliable, if an associated modification of the magnetic flux is also measured. The metrological recording of the magnetic flux is contactless.

20 Claims, 5 Drawing Sheets

METHOD AND DEVICE FOR OPERATING A SWITCHING DEVICE

This application is the national phase under 35 U.S.C. §371 of PCT International Application No. PCT/EP2005/057075 which has an International filing date of Dec. 22, 2005, which designated the United States of America, the entire contents of each of which are hereby incorporated herein by reference.

FIELD

At least one embodiment the present invention generally relates to a method for operating a switching device and/or a corresponding device.

BACKGROUND

Switching devices, in particular low voltage switching devices, can be used to switch the current paths between an electrical supply device and loads, and therefore to switch their operating currents. Thus, the switching device opens and closes current paths, allowing the connected loads to be safely connected and disconnected.

An electrical low-voltage switching device, such as for example a contactor, a circuit breaker or a compact starter, has one or more so-called main contacts for switching the conducting paths, which can be controlled by one or also by a number of control magnets or electromagnetic drives, in order to switch the current paths. In principle, in this case, the main contacts include a moving contact bridge and fixed contact pieces, to which the loads and the supply device are connected. In order to close and open the main contacts, an appropriate connection or disconnection signal is passed to the electromagnetic drive, in response to which their armatures act on the moving contact bridges in such a way that the latter carry out a relative movement with respect to the fixed contact pieces, and either close or open the current paths to be switched.

Appropriately designed contact surfaces are provided in order to improve the contact between the contact pieces and the contact bridges at points at which the two meet one another. These contact surfaces are composed of materials such as for example silver alloys, which are applied at these points both to the contact bridge and to the contact pieces, and have a specific thickness.

As a rule, the electromagnetic drive is designed as a solenoid. The solenoid in this case has a plunger coil as excitation coil as well as an armature. For conduction of the magnetic flux, the electromagnetic drive is surrounded by an iron yoke. If a current is now applied to the excitation coil to switch on the switching device, the armature is pulled into the cylindrical opening of the excitation coil. The movement of the armature that finally actuates a contact slider connected mechanically to the armature, which in turn moves the contact bridges to close the main contacts.

A switching device of the kind specified above has a power supply, which generates a low-voltage DC voltage from an alternating input voltage on the network side in the range from 12 V to 24 V for supplying the solenoid current to the excitation coil. Typical input voltages on the network side are 230 V at 50 Hz or 110 V at 60 Hz. Newer clocked power supplies have a broad input voltage range from approximately 100 V to 230 V. The power supply can also supply an electronic control unit and an electronic monitoring unit of the switching device with current.

During the switch-on process, i.e. in the period of time of the connection of the power supply to the excitation coil up to reaching an ON position at which the armature is fully drawn in, the current requirement of the excitation coil is particularly high. This is explained by the magnetizing current for establishing the magnetic field as well as for the conversion of magnetic energy into mechanical kinetic energy. Were this solenoid current to continue to be provided after reaching the ON position, the excitation coil would heat up in such a manner that erosion of the excitation coil and thereby a failure of the switching device would be the result.

For this reason, the solenoid current is restricted to a holding current, which in comparison to the maximum current is substantially smaller during the switch-on process. This can for example be produced by way of a timing circuit which, after a predeterminable time, brings about a limiting of the solenoid current by the power supply. A disadvantage of this solution is that no feedback is obtained about an actual actuation of the electromagnetic drive. It may be that the main contacts of the switching device are not closed at all by the electromechanical drive. This could be the case for example if dirt has accumulated between the armature and the cylindrical opening of the electromagnetic drive, and this therefore results in these two components of the electromagnetic drive being jammed.

As an alternative, the ON position can be interrogated by way of one or more switching contacts, through which the limiting of the solenoid current can then be brought about by the power supply. A disadvantage of this solution is that the contacts of the switches may become dirty. In this case, as in the case described above, the increased solenoid current would then be supplied again by the power supply with the possible negative consequences mentioned above.

Fault sources such as these in particular must, however, be avoided for the safe operation of switching devices, and therefore for protection of the load and of the electrical installation.

SUMMARY

At least one embodiment of the present invention identifies such potential fault sources, and reacts appropriately to them.

At least one embodiment of the present invention makes possible, at a slight cost, a reliable regulation of the solenoid current and a reliable feedback on the fact that the electromechanical drive has carried out an actuation displacement action.

To this end, according to at least one embodiment of the invention, a modification of the magnetic flux between a first position, when the main contact is deactivated, and a second position, when the main contact is activated, is identified in the electromagnetic drive and a solenoid current of the electromagnetic drive is restricted to a predeterminable minimum current value in the second position, if the magnetic flux modification exceeds a predeterminable value.

When the switching device is switched on, the armature is drawn into the cylindrical opening of the excitation coil of the electromagnetic drive. By moving the armature, the associated contact slider is also actuated, which in turn displaces the contact bridge for closing the main contacts. At the same time, by displacing the armature, the magnetic field is modified in the region of the cylindrical opening of the electromagnetic drive. This modification brings about a change in the magnetic flux, which can then be recorded by a measuring facility. If the magnetic flux modification now exceeds a predeterminable value, the solenoid current is then restricted to a predeterminable minimum value for which the electromagnetic drive remains sufficiently stable in the ON position.

The great advantage of this is that an actuation displacement of the armature can be identified as reliable, if an associated modification of the magnetic flux is identified or measured. The measurement of the magnetic flux is contactless. As a result, wear or contamination of the switching contacts for recording the ON position is avoided.

In a particular embodiment, the magnetic flux modification can be identified by way of an induction coil. In this case, the coil can be fitted as air-core coil in the region of the cylindrical opening of the electromagnetic drive. As an alternative, the coil can have a slightly larger diameter when compared to the diameter of the armature. If the measuring coil is now pushed onto and fastened to the armature, an induction voltage that is induced by the changing magnetic flux can then in the case of an actuation of the armature be measured at the wire ends of the coil. This measuring voltage can be compared for example by way of a comparator to a reference value. The output signal of the comparator can then be relayed as regulation signal to the power supply.

The particular advantage when using a measuring coil is that only then a sufficiently high measuring voltage is induced in the measuring coil, even if the change in the displacement of the armature and in this case the change in the magnetic flux modification take place in a sufficiently fast manner. Thus, during an all too slow actuation displacement of the armature such as for example due to contamination of the armature, also no sufficient voltage is induced in the measuring coil. Therefore, also no signal is generated for the regulation of the solenoid current. This faulty switching behavior can thus be dealt with by a downstream electronic monitoring unit.

As an alternative, the magnetic flux modification can also be identified by way of a magnetic sensor, in particular by way of a Hall sensor. By selecting a Hall sensor with particularly small geometrical dimensions, the magnetic flux modification can be recorded advantageously even under confined conditions.

In a particularly advantageous embodiment, the electromagnetic drive is supported by at least one permanent magnet. The advantage of such drives is that in the ON position and in the OFF position, an additional retaining force is generated on the armature. When switching the electromagnetic drive supported by the permanent magnet on and off, these additional retaining forces are overcome, which leads to a displacement of the magnetic flux of the permanent magnet or the permanent magnets in the magnetic circuit. A modification of the magnetic flux of the permanent magnet or the permanent magnets can then be identified or measured with the aid of the measuring device previously mentioned. The advantage of permanent magnet supported drives is that a creeping process of the initial displacement hardly ever occurs since the permanent magnetic holding force strongly decreases on the armature after a short path of typically 0.1 mm. Therefore, the armature displacement on average only varies slightly over the switching cycles during the switching on and off processes. As a result, the changeover process takes place suddenly in an advantageous manner so that in the breaking free period, the displacement of the armature takes place immediately and with full force compared to the purely electromagnetic drives.

In a particularly advantageous embodiment, the magnetic flux modification is identified or measured outside an excitation coil and outside an internal yoke of the electromagnetic drive surrounding the excitation coil. The iron yoke usually almost completely encloses the excitation coil except for the cylindrical opening for guiding the armature so that the magnetic field generated by the excitation coil is, for the most part, formed for the movement of the armature in the region of the cylindrical opening.

The particular advantage of the above-mentioned arrangement of the measuring device is that a magnetic flux modification is brought about exclusively by a change in the outer permanent magnetic circuit due to the displacement of the armature. A potentially possible disadvantageous overlaying of the magnetic flux excited by the permanent magnet by the (electro)magnetic flux generated by the excitation coil is thereby avoided. As a result, from the modification of the magnetic flux of the permanent magnet or the permanent magnets, an extremely reliable signal can be generated for the regulation of the solenoid current for the excitation coil.

In a further embodiment, the magnetic flux modification can be identified or measured in a scatter field of one of the permanent magnets, which changes depending on the position of the armature as well as the associated magnetically conductive components. This is explained in greater detail in the example of FIG. 2.

In accordance with a further embodiment, an error message is output if, after the expiry of a predeterminable period of time after switching on the solenoid current, a magnetic flux modification is not identified in the electromagnetic drive of the switching device. The predeterminable period of time can be in the range from 0.2 s to 1 s. If no signal can be detected by way of the above-mentioned measuring device within this period of time, it can be assumed that the armature has not moved or has moved too slowly despite the application of the solenoid current. This can for example be caused by contamination or wear of the mechanical components of the electromagnetic drive.

A switching device is also disclosed in at least one embodiment for carrying out the described method in accordance with the invention for switching loads, with the switching device being a contactor, a circuit breaker or a compact branch.

The switching device can also have a device corresponding to the method in accordance with at least one embodiment of the invention for switching loads, with the switching device being a contactor, a circuit breaker or a compact branch.

The switching device in particular may be a three-pole switching device with three main contacts for switching on and switching off three current paths with a magnetic drive.

BRIEF DESCRIPTION OF THE DRAWINGS

The invention as well as advantageous embodiments thereof will be described in more detail below with reference to the following figures, in which.

DETAILED DESCRIPTION OF THE EXAMPLE EMBODIMENTS

Figure 1:
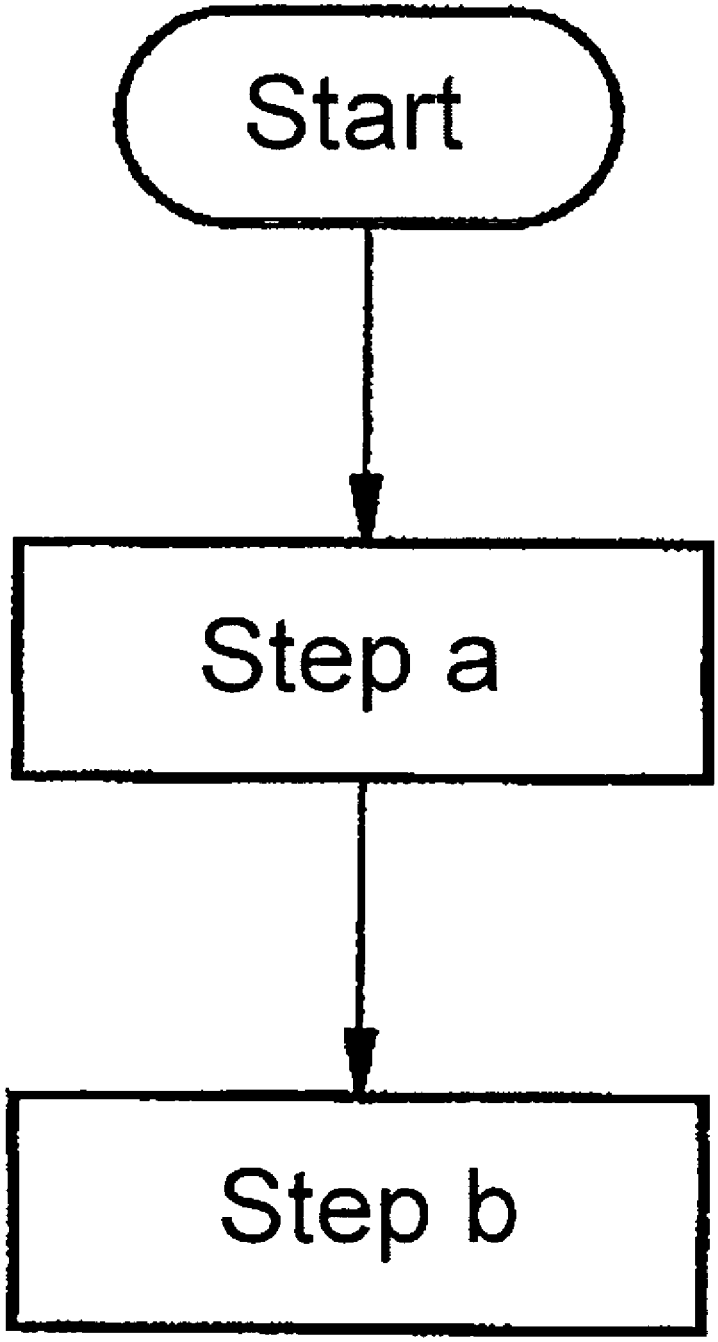
FIG. 1 shows a simplified flow diagram of the method in accordance with an embodiment of the invention.

As illustrated in FIG. 1, the two following steps are essentially carried out in the method in accordance with an embodiment of the invention:

Step a) Identification of a magnetic flux modification in the electromagnetic drive between a first position with a switched-off main contact and a second position with a switched-on main contact, and Step b) restriction of a solenoid current of the electromagnetic drive to a predeterminable minimum current value in the second position, if the magnetic flux modification has exceeded a predeterminable value.

A modification of the magnetic flux is thus only recorded or measured if the armature of the electromagnetic drive also moves and, in doing so, changes the magnetic circuit of the electromagnetic drive. The measurement of the magnetic flux is contactless.

Figure 2:
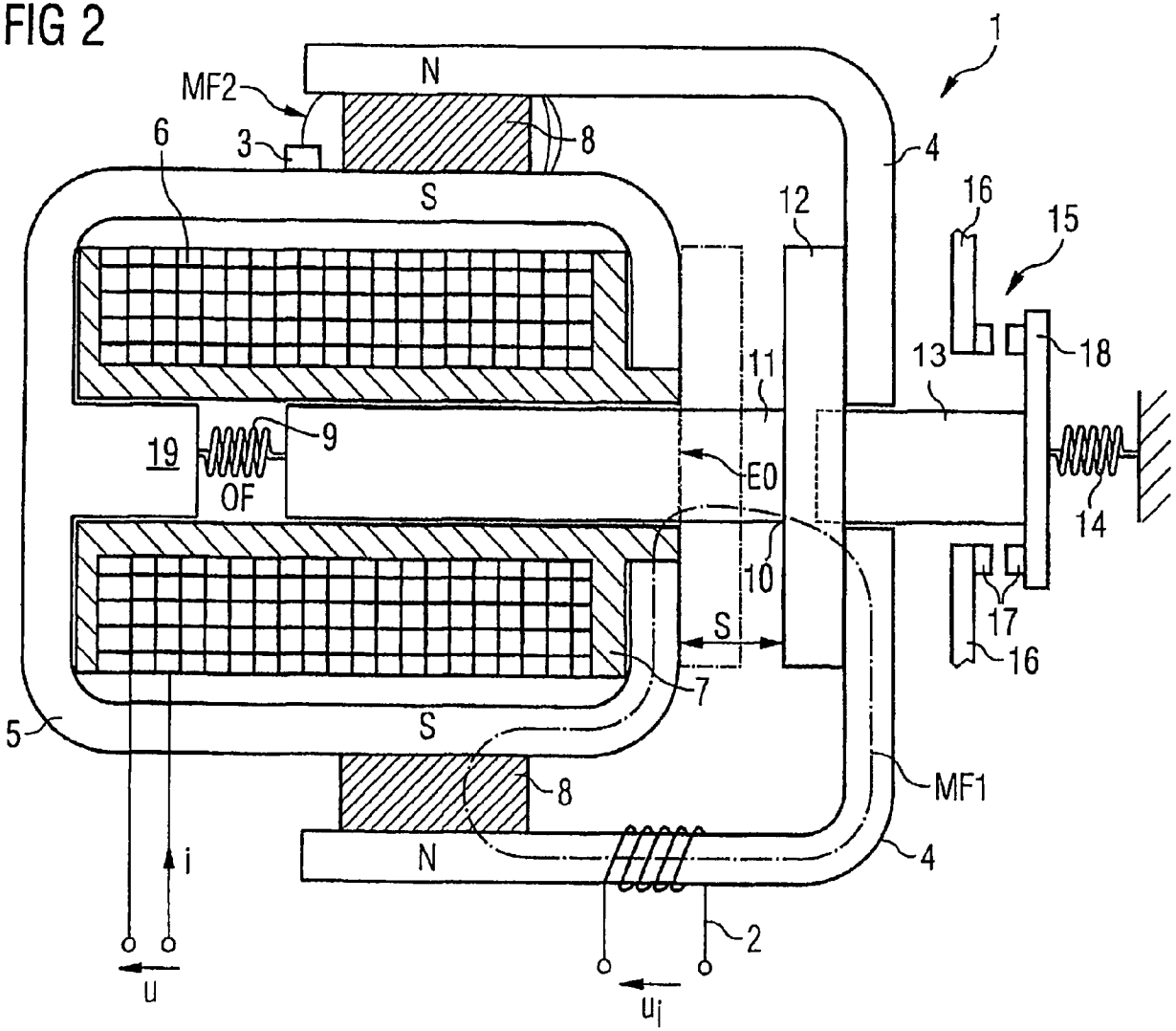
FIG. 2 shows a sectional view through an example embodiment of the device in accordance with an embodiment of the invention with a permanent magnet-supported electromagnetic drive.

FIG. 2 shows a sectional view through an example embodiment of the device in accordance with the invention with a permanent magnet 8 supported electromagnetic drive 1. In the center of the picture an excitation coil 6 is shown, which is coiled onto a coil form 7. The excitation coil 6 for example has two connections for feeding a solenoid current i. The reference symbol u designates the associated coil voltage. The coil form 7 and the excitation coil 6 form a cylindrical opening OF, in which an armature 10 of the electromagnetic drive 1 can move. The armature 10 has a cylindrical pin 11 matched with the dimensions of the cylindrical opening OF as well as a stop plate 12 fitted to it. In this case, the entire armature 10 is made of a ferromagnetic and in particular soft magnetic material such as for example iron. The coil form 7 and the excitation coil 6 are surrounded by an internal yoke of a soft magnetic material for conduction of the magnetic flux of the magnetic field generated by the excitation coil 7, with a part of the internal yoke 5 extending into the cylindrical opening OF and forming an internal pole 19 there. In the final analysis, the magnetic field generated in such a way only operates only in the region of the cylindrical opening OF.

In accordance with an embodiment of the invention, a magnetic flux modification is identified in the electromagnetic drive 1 between a first position with a switched-off main contact 15 and a second position with a switched-on main contact 15 and a solenoid current i of the electromagnetic drive 1 is restricted to a predeterminable minimum current value in the second position, if the magnetic flux modification exceeds a predeterminable value. The flux modification can for example be measured by way of a magnetic sensor which is fitted in the starting region EO of the cylindrical opening OF. For reasons of clarity, the magnetic sensor itself is not shown in the example of FIG. 2.

In accordance with an embodiment of the invention, the electromagnetic drive 1 is supported by at least one permanent magnet 8 so that in the ON position and in the OFF position of the electromagnetic drive 1, an additional retaining force is generated in the armature 10. In this case, the permanent magnets 8 are fitted to the exterior of the internal yoke 5 of the electromagnetic drive 1. The magnetic poles of the two permanent magnets 8 are in each case designated with a reference symbol N and S. The permanent magnets 8 are preferably arranged along the periphery of the internal yoke 5. Instead of a plurality of permanent magnets 8, a magnetic ring or circlet can also be used, which is polarized in such a way that a North Pole N or South Pole S forms on the inside thereof and a South Pole S or North Pole N on the outside. In the example of FIG. 2, the side facing towards the outside of the permanent magnets 8 is connected to a pot-shaped soft magnetic outside yoke 4. The outside yoke 4 likewise has a cylindrical opening, in which a contact slider 13 is guided. The contact slider 13 can be actuated by way of a stop plate 12 of the armature 10 so that a contact bridge 18 connected to the contact slider 13 can be moved against fixed contact pieces 16 as the current path. The reference symbol 17 designates the contacts of the main contact 15. A contact spring 14 serves to apply a contacting force to the contact bridge 18 for closing the main contact 15 if the armature 10 is pulled into the cylindrical opening OF during current excitation of the excitation coil 6.

In addition, a reset spring 9 is introduced into the cylindrical opening OF between the internal pole 19 and the cylindrical pin 11 of the armature 10, which in the currentless condition of the excitation coil 6, drives the armature 10 out of the cylindrical opening OF. The geometrical dimensions of the cylindrical pin 11 of the armature 10, the exterior of the internal yoke 5 as well as the inside of the outer yoke 4 are aligned in such a way that the stop plate 12 of the armature 10 in an excited ON position strikes against the exterior of the internal yoke 5 and in the deactivated condition strikes against the inside of the outer yoke 4. In this case, the broken line illustration of the stop plate 12 shows the ON position of the electromagnetic drive 1.

The advantage in the case of such a drive 1 supported by a permanent magnet 8 is that a creeping of the initial displacement hardly ever occurs in the case of changeover processes since the permanent magnetic holding force strongly decreases on the armature 10 after a short path of typically 0.1 mm. Therefore, the armature displacement on average only varies slightly over the switching cycles during the switching on and off processes. As a result, the changeover process takes place suddenly so that in the breaking free period, the displacement of the armature 10 occurs immediately and with full force compared to the purely electromagnetic drives.

In the lower half of FIG. 2, the curve of the magnetic field MF1 due to the permanent magnet is depicted as a dotted and dashed line for the OFF position of the electromagnetic drive 1. In the upper half of FIG. 2, for purposes of comparison, the curve of the magnetic field MF2 due to the permanent magnet 8 is drawn for the ON position of the electromagnetic drive 1. In the latter case, there is no path with a small magnetic resistance for the magnetic field MF2 over the outer yoke 4, so that inevitably a magnetic scatter field is formed around the specific permanent magnet 8. In accordance with the invention, a modification of the magnetic flux or the permanent magnets 8 can now be identified or measured with the aid of the measuring device previously mentioned.

In accordance with a further embodiment, the magnetic flux modification can be identified outside an excitation coil 6 and outside an internal yoke 5 of the electromagnetic drive 1 surrounding the excitation coil 6. For this purpose, in the example of FIG. 2, a measuring coil 2 is coiled around a limb of the outer yoke 4. Starting at the OFF position, the magnetic flux MF1 flows through the measuring coil 2 in a stationary manner. If the armature 10 now moves suddenly to the left to the ON position, the curve of the magnetic flux then also changes suddenly in such a way that a scatter field MF2 is also formed in accordance with the illustration of FIG. 2 in the lower region, with the magnetic flux in the outer yoke 4 disappearing at the same time. This dynamic change in the magnetic flux in the limb of the outer yoke 4 expresses itself in an induction voltage applied to the connections of the measuring coil 2, the peak value of which increases proportionately to the speed at which the magnetic flux changes.

The magnetic flux modification can as an alternative or in addition be identified or measured in a scatter field MF2 of one of the permanent magnets 8. In this case, in the example of FIG. 2, a magnetic sensor or a Hall sensor 3 is fitted to the outside of the internal yoke 4 and in the region of the upper permanent magnets. On the basis of the OFF position of the electromagnetic drive 1, the magnetic flux stretches—as shown in the lower region of FIG. 2—from the North Pole N over the outer yoke 4, further over the stop plate 12 and the cylindrical pin 11 of the armature 10 into the internal yoke 5 in the initial region EO of the cylindrical opening OF to the South Pole S of the permanent magnet 8. Because the magnetic resistance over these soft magnetic components 4, 12, 11, 5 is particularly low, a significant scatter field is not formed around the permanent magnet 8. In this way, the lateral region around the permanent magnet 8 is thus field-free as far as possible. Therefore, the Hall sensor 3 outputs a measuring signal with a correspondingly low measured value to the magnetic flux. For reasons of clarity, the electrical connections of the Hall sensor 3 itself are not shown. If the armature 10 now moves suddenly to the left to the ON position, the curve of the magnetic flux then also changes suddenly in such a way that a scatter field MF2 is formed, with the magnetic flux in the outer yoke 4 disappearing at the same time. A part of the scatter field MF2 now also flows through the Hall sensor 3, which now in addition indicates a correspondingly high measured value.

Figure 3:
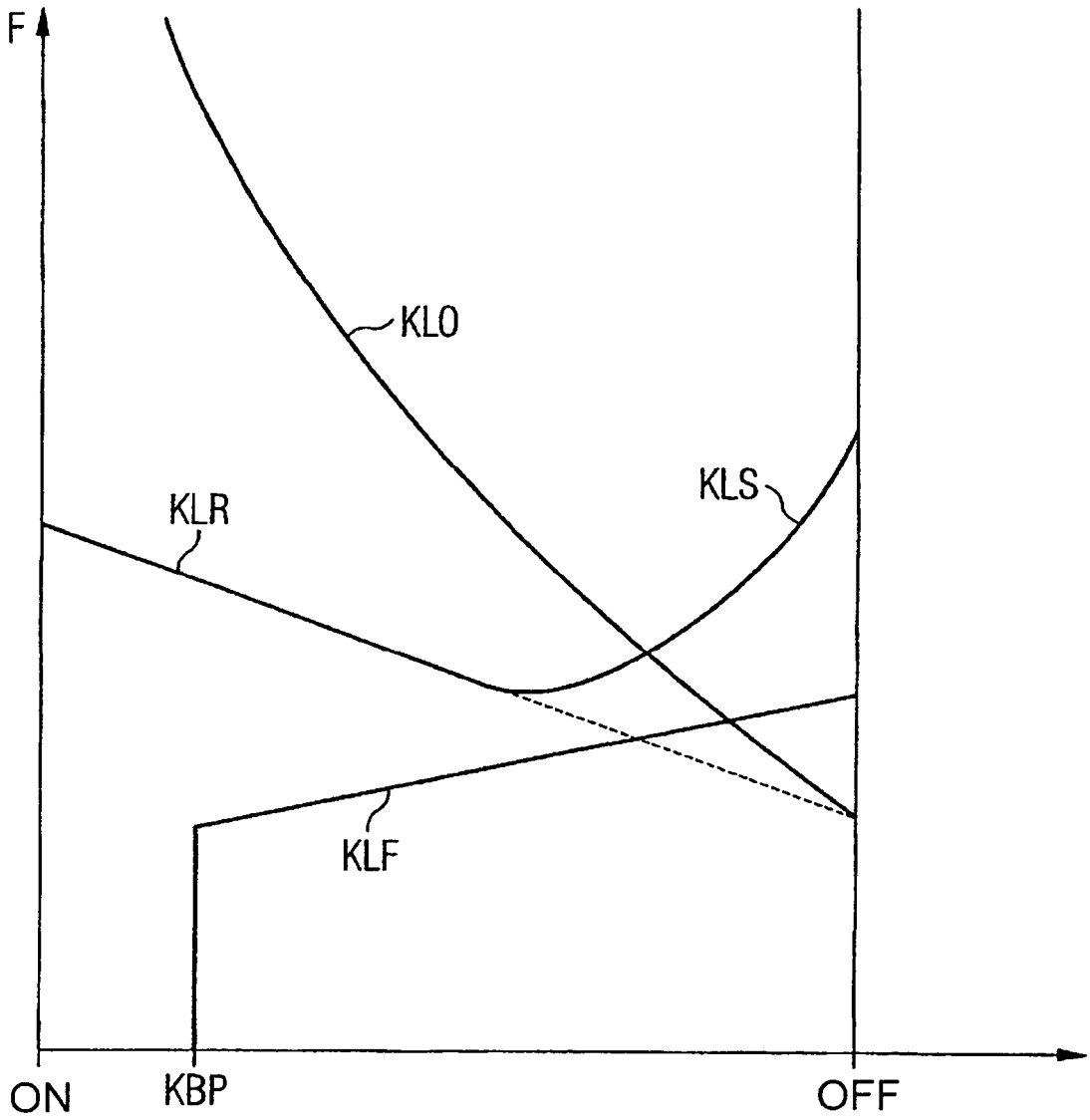
FIG. 3 shows a force/path diagram in which the force of the respective components of the electromagnetic drive in accordance with FIG. 2 is plotted over the path between the ON and OFF position.

FIG. 3 shows a force/path diagram in which the force F of the respective components 9, 10, 19 of the electromagnetic drive in accordance with FIG. 2 is plotted over the path S between the ON position ON and the OFF position OFF. KBP designates the contact point. Starting from this point KBP, the contact spring force sets in from the ON position ON. This is shown by the associated characteristic curve KLF. A cause for this is that starting from this point, the stop plate 12 in its movement from left to right in accordance with FIG. 2, hits the contact slider 13, and then takes it along. The limit stop of the contact slider 13 is represented by a broken line at this point KBP in the example of FIG. 2. A spring resetting force works against the contact spring force according to the characteristic KLR, which decreases with an increasing path of the armature 10 towards the OFF position OFF. The characteristic KLO shows the curve that depends on the distance of the force in the armature 10 in the case of an electromagnetic drive without force support by permanent magnets 8. As shown in FIG. 3, the force of the reset spring 9 still acting on the contact bridge 18 is relatively small. On the other hand, the characteristic KLS when compared to the characteristic KLR shows an increasing force determined by the magnetic flux setting in now over the outer yoke 5 in accordance with FIG. 2, if the armature 10 moves towards the OFF position OFF.

Figure 4:
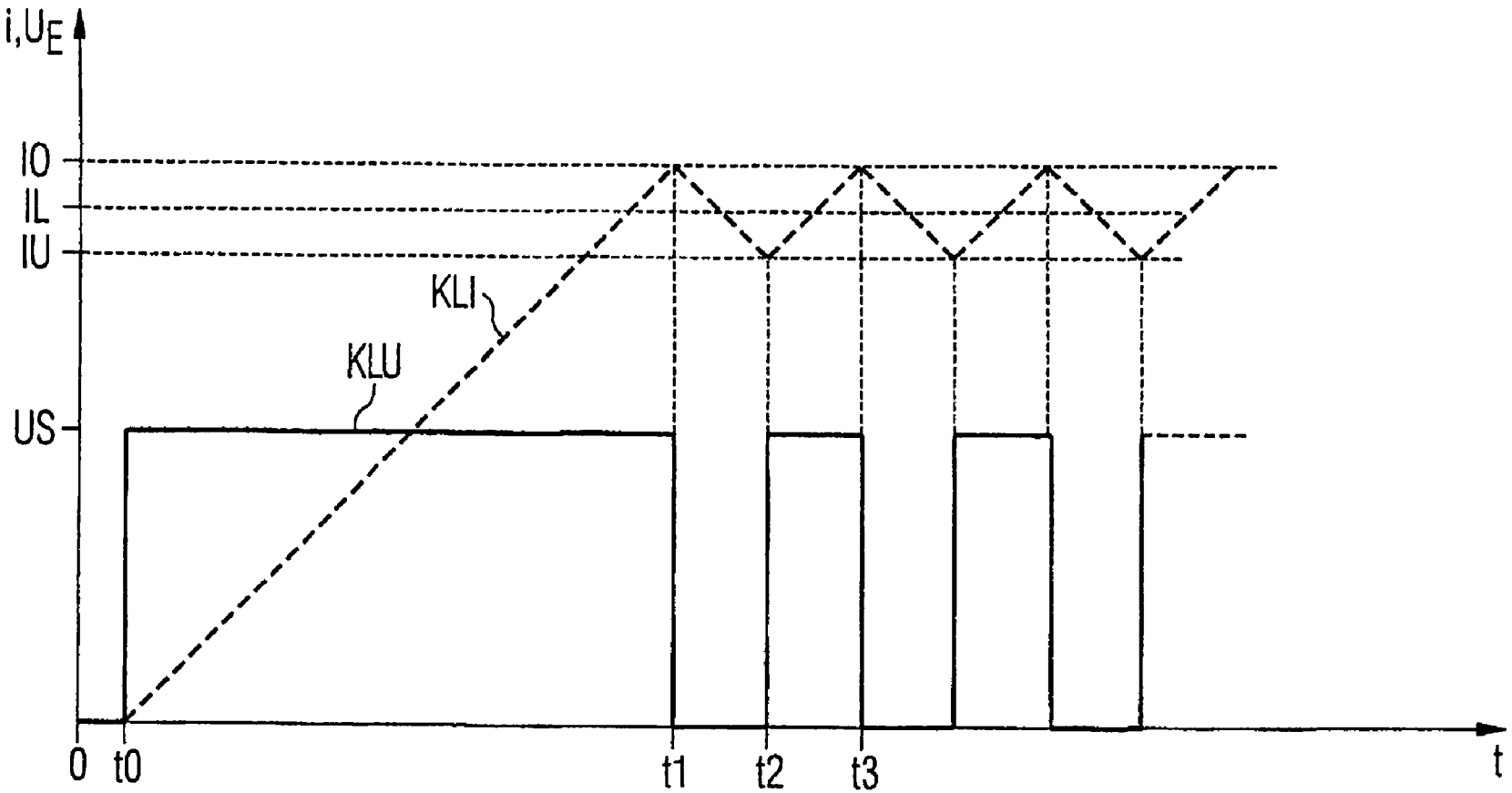
FIG. 4 shows an example circuit diagram for restricting the solenoid current of the excitation coil in accordance with FIG. 2.

FIG. 4 shows an example circuit diagram for restricting the solenoid current i of the excitation coil 6 in accordance with FIG. 2. In the left part of FIG. 4, a rectifier 21 is represented, which converts an AC voltage AC on the input side into a DC voltage US. This DC voltage US is subsequently supplied to a stepdown controller by way of a controllable electronic switching element 22, which in turn feeds the excitation coil 28 of the electronic drive in accordance with FIG. 2 with the solenoid current i. In this case, a voltage $u_E$ is applied to the electronic switching element 22, which depending on the switching state of the switching element 22 corresponds to the switching voltage US or a voltage value close to 0 V. In the closed state of the switching element 22, a load inductance 24 is loaded via the rectifier 21. In the open state of the switching element 22, a freewheeling diode 26 relays the solenoid current i. An example resistor 23 serves as a measuring resistor for recording the actual current i, with a proportionately small current flow through a filter condenser 27 able to be ignored. u designates the voltage over the excitation coil 28. In the right part of FIG. 4, a measuring coil 29 can be seen, in which a voltage $u_i$ is induced during a flux modification of the magnetic field in the electromagnetic drive. This induction voltage $u_i$, together with a measuring voltage $u_R$, which is proportional to the solenoid current i, is recorded and processed by an electronic control unit 25.

When a switching-on command ON is given, the electronic control unit 25 now first of all makes available a high solenoid current i, so that the armature 10 can be moved safely from the OFF position OFF to the ON position ON. The breaking free of the armature 10 from the OFF position OFF, brings about a magnetic flux modification. The electronic control unit 25 now records a sufficiently high pulsed voltage $u_i$ and then in a regulating loop restricts the solenoid current i to a predeterminable minimum current value. To this end, the control unit 25 activates the electronic switching element 22 in a clocked manner.

Figure 5:
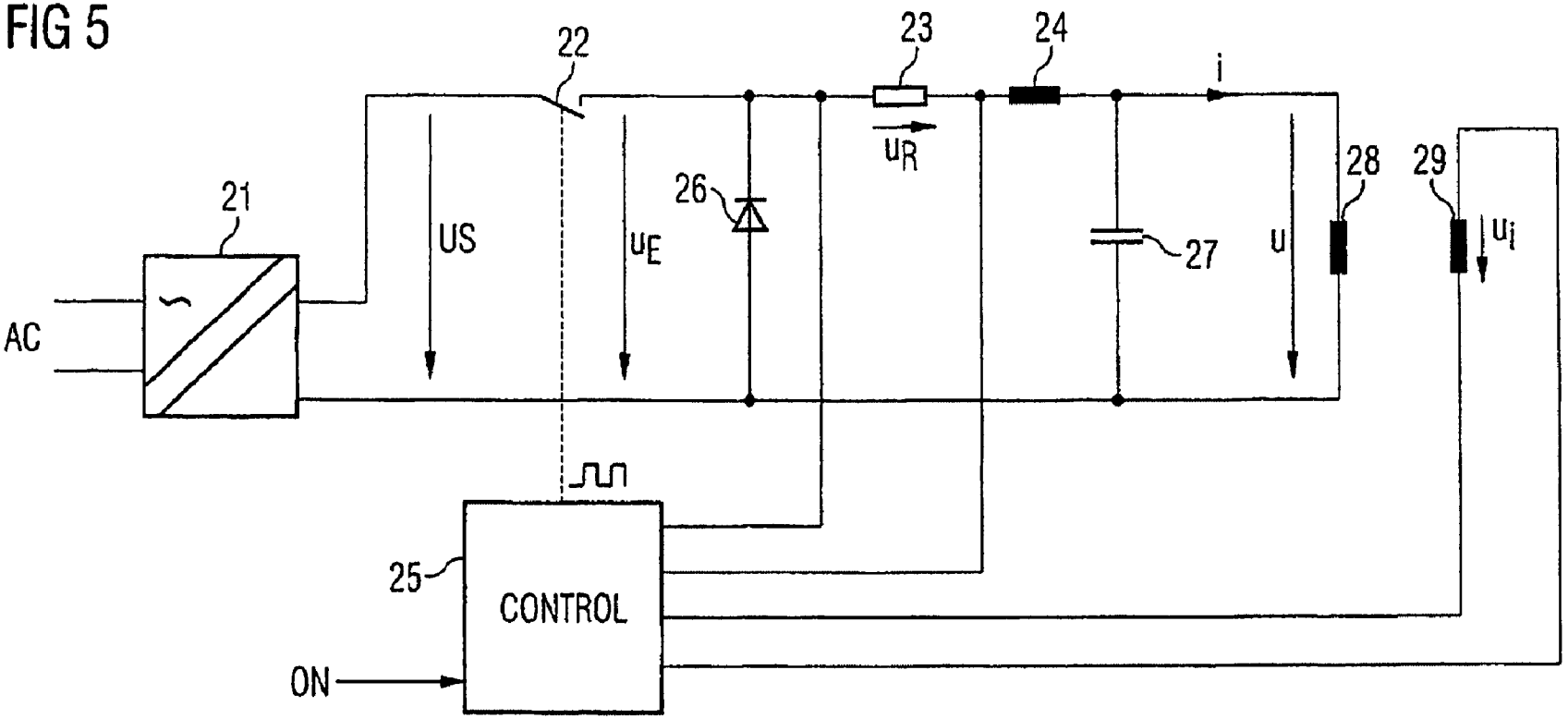
FIG. 5 shows an example timing curve of the solenoid current as well as the input voltage of the power supply for the device in accordance with FIG. 2.

FIG. 5 shows an example curve in time of the solenoid current i as well as the input voltage $u_E$ of the power supply for the device in accordance with FIG. 2. The voltage curve KLU of the input voltage $u_E$ is plotted in the lower part of the time diagram and the current path KLI of the solenoid current i in the upper part. At the point in time t0, the control unit 25 in accordance with FIG. 4 receives, a switching-on command ON, whereupon this control unit then first of all connects the switching voltage US in full. At the point in time t1, the armature 10 breaks free from the outer yoke 5, whereby a regulation signal in the form of an induced voltage signal $u_i$ is generated in the measuring coil 29 in accordance with FIG. 4. As a result, the control unit 25 regulates the solenoid current i in such a way that it fluctuates between the two current changeover values IO and IL and on average corresponds to an averaged current value IL.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A method for operating a switching device using at least one electromagnetic drive, which includes a displaceable armature for opening and closing at least one main contact of the switching device, the method comprising:

identifying a magnetic flux modification in a cylindrical opening formed between an excitation coil and a coil form of the electromagnetic drive by identifying a change in an outer permanent magnetic due to displacement of a movable armature within the cylindrical opening, the magnetic flux modification occurring due to a change between a first position with a switched-off main contact of the electromagnetic drive and a second position with a switched-on main contact of the electromagnetic drive; and restricting a solenoid current of the electromagnetic drive to a certain current value in the second position, when the magnetic flux modification exceeds a threshold value wherein an error message is output if, after the expiry of a period of time after switching on the solenoid current, a magnetic flux modification is not identified in the electromagnetic drive of the switching device.

2. The method as claimed in claim 1, wherein the magnetic flux modification is identified by way of an induction coil.

3. The method as claimed in claim 2, wherein the magnetic flux modification is identified by way of a magnetic sensor.

4. The method as claimed in claim 1, wherein the magnetic flux modification is identified by way of a magnetic sensor.

5. The method as claimed in claim 4, wherein the magnetic sensor is a Hall sensor.

6. The method as claimed in claim 1, wherein the electromagnetic drive is at least supported by one permanent magnet; and the magnetic flux modification is identified in a magnetic circuit of the at least one permanent magnet.

7. The method as claimed in claim 6, wherein the magnetic flux modification is identified outside the excitation coil and outside an internal yoke of the electromagnetic drive surrounding the excitation coil.

8. The method as claimed in claim 7, wherein the magnetic flux modification is identified in a scatter field of one of the permanent magnets.

9. A switching device for carrying out the method for switching loads as claimed in claim 1, wherein the switching device is at least one of a contactor, a circuit breaker and a compact branch.

10. A switching device as claimed in claim 9, wherein the switching device is a three-pole switching device with three main contacts for switching on and switching off three current paths with a magnetic drive.

11. The method as claimed in claim 1, wherein the certain current value is a predeterminable minimum current value.

12. A device for operating a switching device using at least one electromagnetic drive, the device comprising:

an excitation coil wound on a coil form within an internal yoke, the excitation coil and the coil form forming a cylindrical opening therein, wherein a portion of the internal yoke extends into the cylindrical opening formed by the excitation coil and the coil form;

a displaceable armature for opening and closing a main contact of the switching device, the displaceable armature being moveable within the cylindrical opening the armature including a cylindrical pin within the cylindrical opening, the cylindrical pin being connected to a contact bridge;

an identifying device that identifies a magnetic flux modification in the cylindrical opening when the contact bridge moves between a first position, when a main contact is deactivated, and a second position, when the main contact is activated; and a restricting device that restricts a solenoid current of the electromagnetic drive to a certain current value in the second position, when the magnetic flux modification exceeds a threshold value wherein an error message is output if, after the expiry of a period of time after switching on the solenoid current, a magnetic flux modification is not identified in the electromagnetic drive of the switching device.

13. The device as claimed in claim 12, wherein that the identifying device includes at least one of an induction coil and a magnetic sensor.

14. The device as claimed in claim 13, wherein the magnetic sensor is a Hall sensor.

15. The device as claimed in claim 12, further including at least one permanent magnet fitted to an exterior surface of the inner yoke and provided to support the electromagnetic drive, the permanent magnet proving an additional retaining force to the cylindrical pin, wherein the magnetic flux modification in the cylindrical opening is identified by a change in the permanent magnet.

16. The device as claimed in claim 15, wherein the identifying device is arranged outside the excitation coil and outside the internal yoke of the electromagnetic drive surrounding the excitation coil.

17. The device as claimed in claim 12, wherein an error message is outputtable if after the expiry of a period of time after switching on the solenoid current, a magnetic flux modification cannot be identified in the electromagnetic drive of the switching device.

18. A switching device for switching loads with a device as claimed in claim 12, wherein the switching device is at least one of a contactor, a circuit breaker and a compact branch.

19. The device as claimed in claim 12, wherein the certain current value is a predeterminable minimum current value.

20. A device for operating a switching device using at least one electromagnetic drive, which has a displaceable armature for opening and closing a main contact of the switching device, comprising:

an excitation coil wound on a coil form, the excitation coil and the coil form forming a cylindrical opening therein;

an internal yoke within which the excitation coil and the coil formed are arranged, a portion of the internal yoke extending into the cylindrical forming an internal pole therein;

a cylindrical pin within the cylindrical opening, the cylindrical pin being connected to a contact bridge;

an identifying device that identifies a magnetic flux modification in the cylindrical opening when the electromagnetic drive moves between a first position, when a main contact is deactivated, and a second position, when the main contact is activated; and a restricting device that restricts a solenoid current of the electromagnetic drive to a certain current value in the second position, if the at least one device identifies that the magnetic flux modification exceeds a threshold value wherein an error message is output if, after the expiry of a period of time after switching on the solenoid current, a magnetic flux modification is not identified in the electromagnetic drive of the switching device.

* * * * *